United States Patent [19]

Slusar et al.

[11] Patent Number: 4,934,220

[45] Date of Patent: Jun. 19, 1990

[54] SEALED REVERSIBLE RATCHET WRENCH

[75] Inventors: Randall J. Slusar, Greenfield; Jeffrey R. Annis, Waukesha; John W. Roberts, Yorkville, all of Wis.

[73] Assignee: Snap-On Tools Corporation, Kenosha, Wis.

[21] Appl. No.: 332,157

[22] Filed: Apr. 3, 1989

[51] Int. Cl.[5] ..... B25B 13/46

[52] U.S. Cl. ..... 81/63.2; 81/63

[58] Field of Search ..... 81/59.1–63.2

[56] References Cited

U.S. PATENT DOCUMENTS

| | | | |
|---|---|---|---|
| 2,407,558 | 9/1946 | Kress | 81/62 X |
| 2,571,939 | 10/1951 | Pfauser et al. | 81/61 X |
| 2,733,567 | 2/1956 | Zellweger | 58/90 |
| 2,735,324 | 2/1956 | Goldwater et al. | 81/60 |
| 2,957,377 | 10/1960 | Hare | 81/63.2 |
| 2,963,929 | 12/1960 | Barnes | 81/62 |
| 3,019,682 | 2/1962 | Hare | 81/63.2 |
| 3,356,117 | 12/1967 | Wagner | 145/71 |
| 3,362,267 | 1/1968 | Rozmus | 81/59.1 |
| 3,656,824 | 4/1972 | Ullberg | 308/187.1 |
| 4,339,970 | 7/1982 | Enstrom | 81/60 |
| 4,457,519 | 7/1984 | Harrington | 277/65 |
| 4,497,227 | 2/1985 | Stasiek | 81/63.1 |
| 4,561,329 | 12/1985 | Lack | 81/62 |
| 4,699,028 | 10/1987 | Bosque | 81/63 X |

*Primary Examiner*—James G. Smith

*Attorney, Agent, or Firm*—Emrich & Dithmar

[57] ABSTRACT

A ratchet mechanism in a reversible ratchet wrench is sealed by novel means. The sealed reversible ratchet wrench includes a ratchet body having a head portion and a handle portion. The head portion has a head cavity formed therein, which cavity receives the ratchet mechanism. The ratchet mechanism communicates exteriorly of the head cavity via at least two journal bearings which respectively receive journal pins associated with the ratchet mechanism. The novel sealing means comprises a pair of annular lip seals, each of which includes an opening that receives one of the journal pins. The annular lip seals bridge the gap between the exteriorly communicating journal bearings and journal pins, thereby facilitating the retention of lubricant and hindering the entry of foreign particles in the head cavity and ratchet mechanism housed therein.

6 Claims, 1 Drawing Sheet

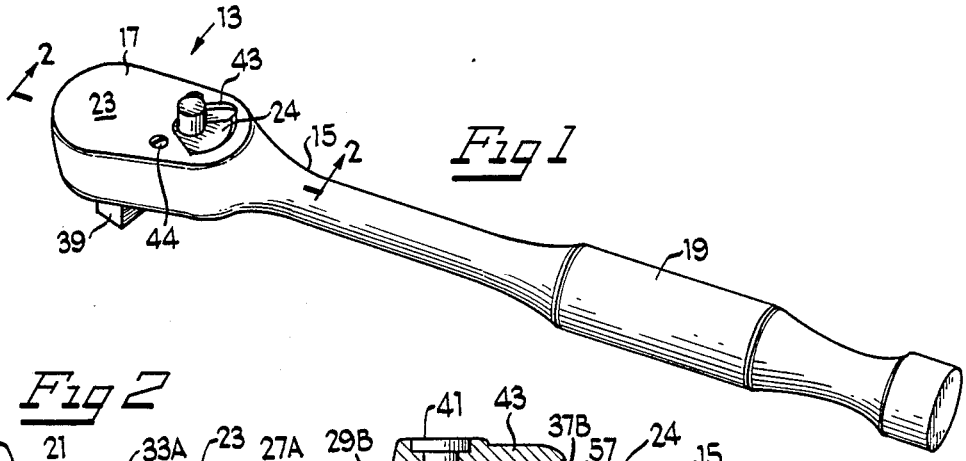
Fig 1
Fig 2
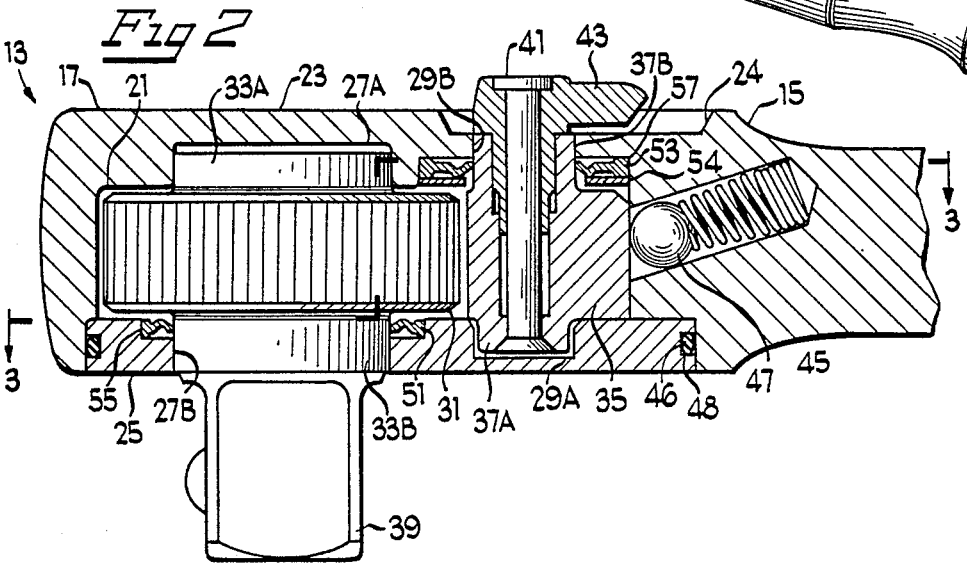
Fig 3
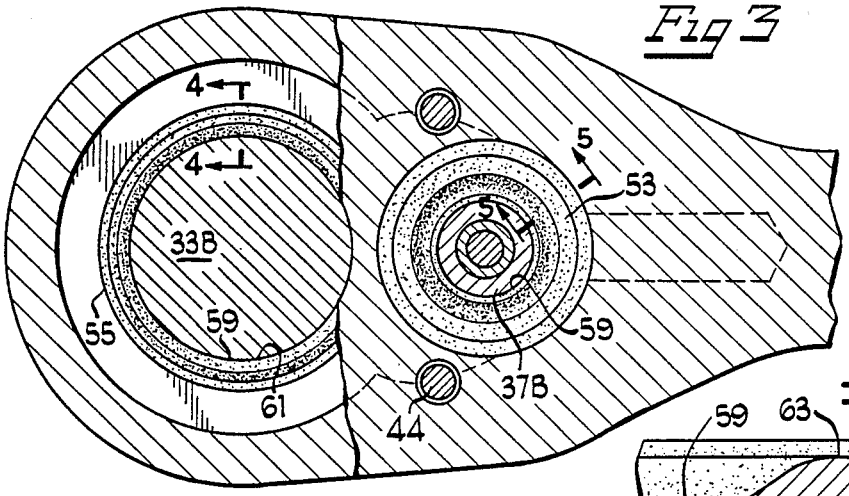
Fig 4
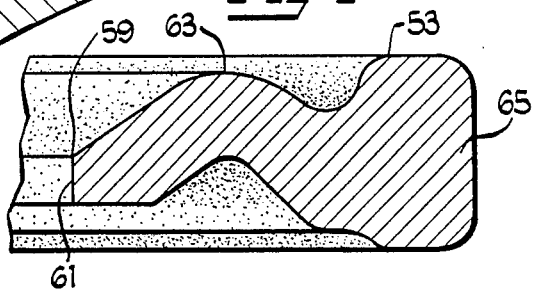
Fig 5
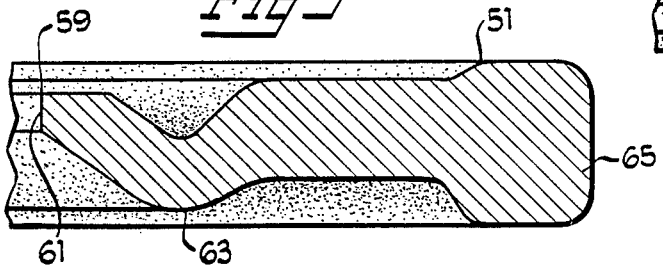

SEALED REVERSIBLE RATCHET WRENCH

Background of the Invention

The present invention relates generally to reversible ratchet wrenches and more specifically to a reversible ratchet wrench wherein the internal ratchet mechanism of the wrench is sealed by novel means. The seal facilitates the retention of lubricant and hinders the entry of foreign particles into the ratchet mechanism.

Reversible ratchet wrenches, employed for turning nuts, bolts and the like, are well known in the art. The ratchets generally include a ratchet body which has a head portion and a handle portion. The head portion has a head cavity formed therein, which head cavity houses a ratchet mechanism. The ratchet mechanism includes a tool drive means which extends exteriorly of the head cavity and which receives a tool. Usually the tool drive means is adapted for receiving a socket which engages the head of a bolt or a nut. The ratchet mechanism permits the tool drive means to freely rotate with respect to the ratchet body, in only one, predetermined, direction. The direction is chosen by the user through actuating means, also located exteriorly of the head cavity. Thus, the ratchet user can communicate torque to a nut or bolt by moving the ratchet handle through an arc, in a predetermined direction which is opposite to the predetermined direction of rotation for the tool drive means. The ratchet mechanism then permits reverse movement of the handle portion, through the same arc, without the application of torque. In locations where the movement of the ratchet handle is limited, such as in the engine compartment of an automobile, the ratchet user can tighten or loosen a nut or bolt without disengaging the nut or bolt from the socket or disengaging the socket from the tool drive means.

Reversible ratchet wrenches can generally be described as being of a round head or pear head configuration. The configuration results primarily from the stacking relationship of a pawl and drive gear which comprise the ratchet mechanism. Pear head ratchets are generally thinner than round head ratchets and are therefore better suited for use where limited space is available.

Because reversible ratchets are used in dirty and dusty environments, ratchet mechanisms often become contaminated with foreign particles. Such contamination can interfere with the smooth operation of the wrench or cause damage to the ratchet mechanism. Furthermore, because the ratchet mechanism contains moving parts, it is desirable that those parts remain sufficiently lubricated to reduce friction and wear. The users of reversible ratchet wrenches must, therefore, frequently disassemble, clean, lubricate and reassemble the wrenches. Thus, sealing the head cavity to prevent the entry of foreign particles and the loss of lubricant from the ratchet mechanism is desirable.

Heretofore, several attempts have been made to seal the head cavity and ratchet mechanism in reversible ratchet wrenches. Most frequently, O-ring seals have been applied to those components of the ratchet mechanism which communicate exteriorly of the head cavity.

The exteriorly communicating components usually include a journal pin, which is received in a journal bearing formed in the head portion of the ratchet body. The O-ring is used to seal the gap between the journal pin and bearing, while permitting relative rotation between the pin and bearing.

The use of O-ring seals for the aforementioned application, has several drawbacks. O-ring seals are said to be axially activated. That is to say, a force, in the axial direction of the journal pin and bearing, is applied to the O-ring. The force deforms the O-ring which causes it to make radial contact with the journal pin. For this reason, O-rings are generally configured as a toroid and fabricated from a compliant material such as rubber. To form an effective seal, a substantially large surface area of the O-ring, adjacent to the inside diameter of the ring, is made to contact the rotating journal pin. This large area of contact, coupled with the radially acting force applied by an O-ring (as a result of the axial pressure), causes substantial frictional drag between the O-ring seal and rotating pin. Furthermore, because the O-ring seal is in sliding contact with the rotating journal pin, wear and deterioration of the seal is quite rapid. U.S. Pat. No. 2,957,377, issued to Hare, discloses the use of such an O-ring seal in connection with a ratchet drive gear and tool drive means.

Other prior art means, such as neoprene washers, have been employed in an attempt to seal ratchet mechanisms in reversible ratchet wrenches. Such washers are subject to the same wear problems as O-rings and do not provide an effective seal.

Summary of the Invention

It is therefore an object of the present invention to provide a reversible ratchet wrench wherein the drive gear and pawl of the ratchet mechanism is sealed.

Another object of the invention is to provide a reversible ratchet wrench which has a sealed head cavity so that it is unnecessary for the user of the wrench to periodically clean and lubricate the ratchet mechanism.

Another object of the present invention is to provide a sealed reversible ratchet wrench wherein the sealing means offers minimal frictional drag to the rotation of the tool drive means and actuating means of the ratchet mechanism of the wrench.

Still another object of the invention is to provide a pear head, reversible ratchet wrench which includes only two exteriorly communicating journal bearings and pins, which journal bearings and pins are sealed by an annular lip seal.

In accordance with the present invention, a sealed reversible ratchet wrench is provided. The ratchet wrench of the invention comprises a ratchet body which includes a handle portion and a head portion. The head portion has a head cavity formed therein which defines a pair of spaced-apart sidewalls having a first and a second pair of coaxial journal bearings formed therein. At least one of the journal bearings in each pair communicates exteriorly of the head cavity. A drive gear is received in the cavity and has a pair of coaxially mounted journal pins, which journal pins are received in the first pair of journal bearings. A double-acting pawl is received in the cavity and is in ratcheting cooperation with the drive gear. The pawl has a pair of coaxially mounted journal pins which are received in the second pair of journal bearings. A tool drive means, adapted for receiving a tool such as a socket, is located exteriorly of the head cavity and is coaxially mounted to the journal pin on the drive gear that is associated with the exteriorly communicating journal bearing of the first pair. A pawl actuating means, which permits the user to select a predetermined direction of rotation for the drive gear and tool drive means is provided. The pawl actuating means includes a lever which is also located exteriorly of the head cavity and is mechanically linked to the journal pin that is associated with the exteriorly communicating journal bearing of the second pair. An annular lip seal is located in the head cavity, adjacent each of the exteriorly communicating journal bearings of each pair. The two annular lip seals respectively receive a journal pin from the drive gear and the pawl, so that a tight, low friction sliding seal is formed around each exteriorly communicating journal bearing in the head portion. Thus, the annular lip seals facilitate the retention of lubricant and hinder the entry of foreign particles in the head cavity of the head portion.

The invention consists of certain novel features and a combination of parts hereinafter fully described, illustrated in the accompanying drawings, and particularly pointed out in the appended claims, it being understood that various changes in the details may be made without departing from the spirit or sacrificing any of the advantages of the present invention.

Brief Description of the Drawings

FIG. 1 is a perspective view of the sealed reversible ratchet wrench of the invention;

FIG. 2 is a fragmentary, partial cross section of the head portion of the sealed ratchet wrench shown in FIG. 1, taken along the line 2—2;

FIG. 3 is a stepped, cross-sectional view of the sealed ratchet head portion shown in FIG. 2, taken along the lines 3—3;

FIG. 4 is an enlarged, fragmentary cross-sectional view of one of the annular lip seals illustrated in FIG. 3, taken along the line 4—4; and FIG. 5 is an enlarged, fragmentary cross-sectional view of the other lip seal shown in FIG. 3, taken along the line 5—5.

Detailed Description of the Preferred Embodiment

Referring now to the drawings, and in particular to FIGS. 1 and 2, it can be seen that the sealed reversible ratchet wrench of the invention, generally indicated by reference numeral 13, comprises a ratchet body 15 which includes a head portion 17 and a handle portion 19. The ratchet wrench of the invention 13 is of a pear head configuration and the head portion 17 has a head cavity 21 formed therein. The head cavity 21 defines a pair of spaced-apart sidewalls 23 and 25 which have a first 27A and 27B and a second 29A and 29B pair of coaxial journal bearings formed therein. At least one of the journal bearings of each pair (i.e. 27B and 29B) communicates exteriorly of the head cavity 21. A drive gear 31, having a pair of coaxially mounted journal pins 33A and 33B, is received in the cavity 21 in such a manner that journal pins 33A and 33B are received in the first pair of journal bearings 27A and 27B, respectively. A double-acting pawl 35 is also received in head cavity 21 and is in ratcheting cooperation with the drive gear 31. The pawl 35 has a pair of coaxially mounted journal pins 37A and 37B which are received in the second pair of journal bearings 29A and 29B, respectively.

A tool drive means 39 is located exteriorly of the head cavity 21 and is coaxially mounted to journal pin 33B, which is associated with exteriorly communicating journal bearing 27B. The illustrated drive means 39 is adapted for receiving a socket (not shown). The tool drive means 39 is rotatable in only one, predetermined direction by virtue of the ratcheting cooperation between drive gear 31 and double-acting pawl 35. A pawl actuating means 41, which includes a reverse lever 43, is used to select the predetermined direction of rotation. The reverse lever 43 is also located exteriorly of the head cavity 21 and is mechanically linked to journal pin 37B, which is associated with exteriorly communicating journal bearing 29B. The lever 43 turns the pawl 35, causing it to engage drive gear 31 in ratcheting fashion in accordance with the desired, predetermined direction of rotation. Thus, the reverse lever 43 is movable between two operating positions which correspond to the ratcheting positions of pawl 35 and hence, the predetermined direction of rotation. The operating positions of reverse lever 43 correspond to the end points of the rotation of lever 43 within an arc-shaped depression 24 formed in sidewall 23 (FIG. 1). A compression spring means 45 and a ball 47 cooperate with pawl 35 in a known manner so that the chosen ratcheting position of pawl 35 is secured and so that ratcheting cooperation is maintained between pawl 35 and drive gear 31 during use of the ratchet wrench 13.

FIG. 2 shows that side wall 25 is fabricated as an independent component whereas sidewall 23 is formed integral with the ratchet body 15. Side wall 25 is so made to permit assembly of the ratchet mechanism housed in head cavity 21. FIGS. 1 and 3 show fastener means in the form of screws 44 which are used to secure sidewall 25 to ratchet body 15. An O-ring seal 46, received in a circumferential groove 48 formed in the sidewall 25, is used to seal the head cavity at the juncture created by the employment of the independent sidewall 25.

Referring again to FIG. 2, a pair of annular lip seals 51 and 53 are located in head cavity 21. One of the pair is adjacent each of the exteriorly communicating journal bearings 27B and 29B. The lip seals 51 and 53 are received in recesses 55 and 57, respectively. The function of lip seals 51 and 53 is to provide a closure between journal pins 33B and 37B and exteriorly communicating journal bearings 27B and 29B.

Because journal pins 33B and 37B must rotate freely in journal bearings 27B and 29B, respectively, clearance must be provided therebetween. Typically this clearance is on the order of 0.006 inch, which is large enough to permit the entry of harmful foreign particles into head cavity 21 and the leakage of lubricant therefrom. Thus, in accordance with the present invention, lip seals 51 and 53 have been provided to bridge this tolerance.

FIGS. 3 through 5 best illustrate the overall configuration of annular lip seals 51 and 53. The lip seals 51 and 53 have an inside opening 59 which receives journal pins 33B and 37B, respectively. The opening 59 presents a cylindrical, inside wall 61 which is coaxial with journal pins 33B and 37B when lip seals 51 and 53 are mounted in recesses 55 and 57, respectively, as shown in FIGS. 2 and 3.

The inside diameter of the opening 59, formed in each lip seal 51 and 53, is made very slightly larger than the diameter of the journal pins 33B and 37B associated therewith. Thus, journal pins 33B and 37B are easily received in openings 59 and lip seals 51 and 53 are not subject to tensile stresses in the vicinity of inside wall 61.

In order to bridge the tolerance between journal pins 33B and 37B and journal bearings 27B and 29B, the inside wall 61 of lip seals 51 and 53 is made to contact the journal pin associated therewith. This contact is carried out by the radial compression of lip seals 51 and 53.

FIGS. 3 and 4 show that lip seals 51 and 53 include a bias spring member 63 and a shoulder ring 65. The outside diameter of shoulder ring 65 is made slightly larger than the inside diameter of the recess (55 or 57) which receives the lip seal (51 or 53). Thus, the insertion of lip seals 51 and 53 into recesses 55 and 57, respectively, causes radial compression of the seals. Inside wall 61 is then forced into radial contact with the associated journal pin. Because bias spring member 63 has a relatively thin cross section, the radial displacement caused by the compression of shoulder ring 65, which is in excess of that required for contact between the inside wall 61 and the journal pin associated therewith, is readily taken up by the deformation of bias spring member 63. The relatively thin cross section of bias spring member 63 also insures that the radial force, and hence the frictional drag, which is exerted by lip seals 51 and 53 on journal pins 33B and 37B is minimal.

In the preferred embodiment of the invention, the radial compression of annular lip seals 51 and 53 may be carried out by fabricating lip seals 51 and 53 with an outside diameter that is about .012 inch greater than the inside diameter of the recess (55 or 57) in which it is received.

Because annular lip seals 53 and 55 must remain compliant in order to function properly, they are preferably made from a nitrile polymer. This material is easily molded and retains its desirable compliant physical properties over a wide range of temperatures, even when in contact with petroleum-based lubricants.

It should be noted that lip seal 53 is held in position by a washer 54. Washer 54 is also received in recess 57 but offers no resistance to the rotation of journal pin 37B, as its inside diameter is substantially larger than the diameter of pin 37B. The sole function of washer 54 is to prevent lip seal 53 from sliding out of recess 57 and becoming damaged through contact with drive gear 31. In the illustrated embodiment of the invention 13, no such retaining washer is necessary in the case of lip seal 51 as the seal is held in place by the close fit between sidewalls 23 and 25 and drive gear 31.

The preferred embodiment of the sealed reversible ratchet wrench of the inventions 13 includes only two exteriorly communicating journal bearings and pins which have lip seals associated therewith. In light of the foregoing, it will be obvious to those skilled in the art that the use of lip seals in connection with any greater number of exteriorly communicating journal bearings and pins falls within the scope of the present invention.

In the sealed reversible ratchet wrench of the invention the lip seals prevent foreign particles from entering the head cavity of the wrench and interfering with the operation of the ratchet mechanism. The lip seals further prevent the loss of lubricant from the head cavity, which reduces friction and wear in the ratchet mechanism. Thus, the sealed ratchet wrench of the invention does not require the frequent cleaning and lubrication of prior art wrenches. Because the lip seals provide a seal with a minimum of radial force on the journal pins, the frictional drag exerted by the lip seals on the rotation of the journal pins is negligible. Thus, operation of the wrench is not impaired by the sealing means.

It will be appreciated that while the foregoing description of the sealed reversible ratchet of the invention includes specific details as to elements such as ratchet bodies, independent sidewalls, etc. that such details are for the purpose of illustrating the apparatus and not intended as a limitation of the scope of the invention.

What is claimed is:

1. A sealed reversible ratchet wrench comprising:

a ratchet body which includes a handle portion and a head portion;

the head portion having a head cavity formed therein which head cavity defines a pair of spaced-apart sidewalls;

the sidewalls having a first and second pair of coaxial journal bearings formed therein;

at least one of the journal bearings in each pair communicating exteriorly of the head cavity;

a drive gear received in the head cavity, the drive gear having a pair of coaxially mounted journal pins, which journal pins are received in the first pair of journal bearings;

a double-acting pawl received in the head cavity and in ratcheting cooperation with the drive gear, the pawl having a pair of coaxially mounted journal pins, which pins are received in the second pair of journal bearings;

a tool drive means, located exteriorly of the head cavity and adapted for receiving a tool, which drive means is coaxially mounted to a journal pin on the drive gear, which journal pin is associated with the exteriorly communicating journal bearing of the first pair;

a pawl actuating means which includes a lever located exteriorly of the head cavity, which lever is adapted for turning the pawl and mechanically linked to the journal pin that is associated with the exteriorly communicating journal bearing of the second pair; and a pair of annular lip seals located in the head cavity and respectively adjacent said exteriorly communicating journal bearings, each lip seal including a relatively thick shoulder outside ring and a relatively thin bias spring portion and a relatively thin substantially cylindrical inside wall, one annular lip seal receiving a journal pin from the drive gear and the other annular lip seal receiving a journal pin from the pawl actuating means, the inside wall of each annular lip seal contacting the journal pin associated therewith, so that a tight, low friction sliding seal is formed between each exteriorly communicating journal bearing and journal pin associated therewith, wherein the lip seals are respectively received in a pair of recesses formed in the side walls, each of which recesses has an inside diameter that is smaller than the outside diameter of the associated lip seal thereby causing the cylindrical inside wall of each lip seal to contact the associated journal pin by radial compression of the lip seal, thereby facilitating the retention of lubricant and hindering the entry of foreign particles in the head cavity.

2. The sealed reversible ratchet wrench in accordance with claim 1 wherein the ratchet wrench is of a pear head configuration.

3. The sealed reversible ratchet wrench in accordance with claim 2 wherein no more than two journal bearings are exteriorly communicating.

4. The sealed reversible ratchet wrench in accordance with claim 1 wherein the lip seals are fabricated from a nitrile polymer.

5. The sealed reversible ratchet wrench in accordance with claim 1 wherein one of the sidewalls is formed integral with the head portion and the others of the sidewalls is provided as an independent component.

6. The sealed ratchet wrench in accordance with claim 5 further comprising a circumferential groove formed in the independent sidewall and an O-ring fitted in the groove to seal the head cavity at the juncture created by the employment of the independent sidewall.

* * * * *